US008980054B2

(12) United States Patent
Yang et al.

(10) Patent No.: US 8,980,054 B2
(45) Date of Patent: Mar. 17, 2015

(54) SOFT TISSUE HAVING REDUCED HYDROGEN BONDING

(71) Applicant: Kimberly-Clark Worldwide, Inc., Neenah, WI (US)

(72) Inventors: SeungRim Yang, Gyeonggi-do (KR); JeongKyung Kim, Gyeonggi-do (KR); Jian Qin, Appleton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 13/726,938

(22) Filed: Dec. 26, 2012

(65) Prior Publication Data

US 2014/0174686 A1 Jun. 26, 2014

(51) Int. Cl.

| | |
|---|---|
| ***D21H 17/07*** | (2006.01) |
| ***D21H 21/22*** | (2006.01) |
| ***D21C 1/04*** | (2006.01) |

(52) U.S. Cl.

CPC ..... *D21C 1/04* (2013.01)
USPC ..... 162/146; 162/157.6; 162/158; 162/164.6; 8/190

(58) Field of Classification Search

USPC ..... 162/146, 157.6, 158, 164.1, 164.6, 182, 162/185; 8/181, 190, 189
See application file for complete search history.

(56) References Cited

U.S. PATENT DOCUMENTS

| | | | | |
|---|---|---|---|---|
| 2,306,440 | A | 12/1942 | Winfrid et al. | |
| 2,524,399 | A | 10/1950 | Schoene et al. | |
| 2,892,674 | A | 6/1959 | Robert et al. | |
| 3,124,414 | A | 3/1964 | Dolmetsch | |
| 3,240,797 | A | 3/1966 | Gale | |
| 3,961,892 | A | 6/1976 | Bishop et al. | |
| 4,035,146 | A | 7/1977 | Brenner et al. | |
| 4,186,238 | A | 1/1980 | Holst et al. | |
| 4,372,815 | A | 2/1983 | Newkirk et al. | |
| 4,432,833 | A | 2/1984 | Breese | |
| 4,549,011 | A | 10/1985 | Herzberg et al. | |
| 5,776,394 | A | 7/1998 | Schrott et al. | |
| 5,882,356 | A | 3/1999 | Potter | |
| 5,935,383 | A | 8/1999 | Sun et al. | |
| 6,036,731 | A | 3/2000 | Scheibli et al. | |
| 7,867,361 | B2 | 1/2011 | Salaam et al. | |
| 8,177,859 | B2 * | 5/2012 | Schmidt et al. | 8/181 |
| 2002/0037410 | A1 * | 3/2002 | Criegee et al. | 428/393 |
| 2002/0112830 | A1 | 8/2002 | Bakken et al. | |
| 2003/0131960 | A1 | 7/2003 | McConnell et al. | |
| 2005/0006039 | A1 | 1/2005 | Farrington, Jr. et al. | |
| 2005/0241791 | A1 | 11/2005 | Wolkowicz et al. | |

FOREIGN PATENT DOCUMENTS

| | | | |
|---|---|---|---|
| EP | 0 440 472 | A1 | 8/1991 |
| EP | 0 939 844 | B1 | 11/2005 |
| WO | WO 85/04200 | A1 | 9/1985 |
| WO | WO 99/36620 | A1 | 7/1999 |
| WO | WO 01/23660 | A1 | 4/2001 |
| WO | WO 2005/123699 | A1 | 12/2005 |
| WO | WO 2009/017288 | A1 | 2/2009 |

* cited by examiner

*Primary Examiner* — Dennis Cordray
(74) *Attorney, Agent, or Firm* — Kimberly-Clark Worldwide, Inc.

(57) ABSTRACT

The present invention provides a modified cellulosic fiber having reduced hydrogen bonding capabilities. The modified fiber formed in accordance with the present invention may be useful in the production of tissue products having improved bulk and softness. More importantly, the modified fiber is adaptable to current tissue making processes and may be incorporated into a tissue product to improve bulk and softness without an unsatisfactory reduction in tensile.

6 Claims, 3 Drawing Sheets

SOFT TISSUE HAVING REDUCED HYDROGEN BONDING

BACKGROUND

In the manufacture of paper products, such as facial tissue, bath tissue, paper towels, dinner napkins, and the like, a wide variety of product properties are imparted to the final product through the use of chemical additives applied in the wet end of the tissue making process. Two of the most important attributes imparted to tissue through the use of wet end chemical additives are strength and softness. Specifically for softness, a chemical debonding agent is normally used. Such debonding agents are typically quaternary ammonium compounds containing long chain alkyl groups. The cationic quaternary ammonium entity allows for the material to be retained on the cellulose via ionic bonding to anionic groups on the cellulose fibers. The long chain alkyl groups provide softness to the tissue sheet by disrupting fiber-to-fiber hydrogen bonds in the sheet. The use of such debonding agents is broadly taught in the art. Such disruption of fiber-to-fiber bonds provides a two-fold purpose in increasing the softness of the tissue. First, the reduction in hydrogen bonding produces a reduction in tensile strength thereby reducing the stiffness of the sheet. Secondly, the debonded fibers provide a surface nap to the tissue web enhancing the "fuzziness" of the tissue sheet. This sheet fuzziness may also be created through use of creping as well, where sufficient interfiber bonds are broken at the outer tissue surface to provide a plethora of free fiber ends on the tissue surface. Both debonding and creping increase levels of lint and slough in the product. Indeed, while softness increases, it is at the expense of an increase in lint and slough in the tissue relative to an untreated control. It can also be shown that in a blended (non-layered) sheet the level of lint and slough is inversely proportional to the tensile strength of the sheet. Lint and slough can generally be defined as the tendency of the fibers in the paper web to be rubbed from the web when handled.

It is also broadly known in the art to use a multi-layered tissue structure to enhance the softness of the tissue sheet. In this embodiment, a thin layer of strong softwood fibers is used in the center layer to provide the necessary tensile strength for the product. The outer layers of such structures are composed of the shorter hardwood fibers, which may or may not contain a chemical debonder. A disadvantage to using layered structures is that while softness is increased the mechanism for such increase is believed due to an increase in the surface nap of the debonded, shorter fibers. As a consequence, such structures, while showing enhanced softness, do so with a trade-off in the level of lint and slough.

It is also broadly known in the art to concurrently add a chemical strength agent in the wet-end to counteract the negative effects of the debonding agents. In a blended sheet, the addition of such agents reduces lint and slough levels. However, such reduction is done at the expense of surface feel and overall softness and becomes primarily a function of sheet tensile strength. In a layered sheet, strength chemicals are added preferentially to the center layer. While this perhaps helps to give a sheet with an improved surface feel at a given tensile strength, such structures actually exhibit higher slough and lint at a given tensile strength, with the level of debonder in the outer layer being directly proportional to the increase in lint and slough.

There are additional disadvantages with using separate strength and softness chemical additives. Particularly relevant to lint and slough generation is the manner in which the softness additives distribute themselves upon the fibers.

Bleached Kraft fibers typically contain only about 2-3 milliequivalents of anionic carboxyl groups per 100 grams of fiber. When the cationic debonder is added to the fibers, even in a perfectly mixed system where the debonder will distribute in a true normal distribution, some portion of the fibers will be completely debonded. These fibers have very little affinity for other fibers in the web and therefore are easily lost from the surface when the web is subjected to an abrading force.

Therefore there is a need for a means of reducing lint and slough in soft tissues while maintaining softness and strength.

SUMMARY

It has now been surprisingly discovered the sheet bulk of a tissue web may be increased, with only minimal degradation in tensile strength, by forming the web with at least a portion of cellulosic fiber that has been reacted with either a water soluble cyanuric halide or a water soluble vinyl sulfone. Reacting cellulosic fiber with either a water soluble cyanuric halide or a water soluble vinyl sulfone results in a modified fiber having fewer hydroxyl groups available to participate in hydrogen bonding when the web is formed. The reduced hydrogen bonding results in a bulkier web that is also softer and less stiff.

Accordingly, in one embodiment the present invention provides a method of increasing the bulk of a tissue web comprising the steps of reacting cellulosic fiber with a water soluble reagent selected from the group consisting of a cyanuric halide having the general Formula (I):

(I)

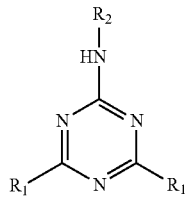

where $R_1$ equals F, Cl, Br, or I and $R_2$ equals $(CH_2)_n$—OH (n=1-3), $(CH_2)_n$—COOH (n=1-3), $C_6H_5$—COOH, or $HSO_3X$ where X equals $(CH_2)_n$ (n=1-3) or $C_6H_4$, and a vinyl sulfone having the general Formula (II):

(II)

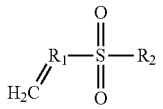

where $R_1$ equals a hydrocarbon having from about 1 to about 5 carbon atoms and $R_2$ equals $CH_3$, HC═$CH_2$, $(CH_2)_n$—$CH_3$ (n=1-3), $(CH_2)_n$—COOH (n=1-3), $C_6H_4$—COOH, or $C_6H_5$; treating the cellulosic fiber with a caustic agent; washing the cellulosic fiber; and forming a tissue web from the cellulosic fiber, wherein the tissue web has a basis weight greater than about 10 grams per square meter (gsm), such as from about 10 to about 50 gsm and a sheet bulk greater than about 5 cc/g, such as from about 10 to about 20 cc/g.

In another embodiment the present invention provides a tissue web comprising modified wood pulp fibers having a nitrogen content greater than about 0.2 weight percent, the tissue web having a basis weight from about 10 to about 60 gsm and a sheet bulk greater than about 10 cc/g.

In still other embodiments the present invention provides a tissue web comprising modified wood pulp fibers having a sulfur content greater than about 0.5 weight percent, the tissue web having a basis weight from about 10 to about 60 gsm and a sheet bulk greater than about 10 cc/g.

In yet another embodiment the present invention provides a tissue product comprising one or more plies, wherein at least one ply comprises a tissue web comprising modified wood pulp fibers having a sulfur content greater than about 2 weight percent, the tissue product having a basis weight from about 10 to about 60 gsm and a sheet bulk greater than about 10 cc/g.

In still another embodiment the present invention provides a tissue product comprising one or more plies, wherein at least one ply comprises a tissue web comprising modified wood pulp fibers having a nitrogen content greater than about 0.2 weight percent, the tissue product having a basis weight from about 10 to about 60 gsm and a sheet bulk greater than about 10 cc/g.

Other features and aspects of the present invention are discussed in greater detail below.

DEFINITIONS

Figure 1:
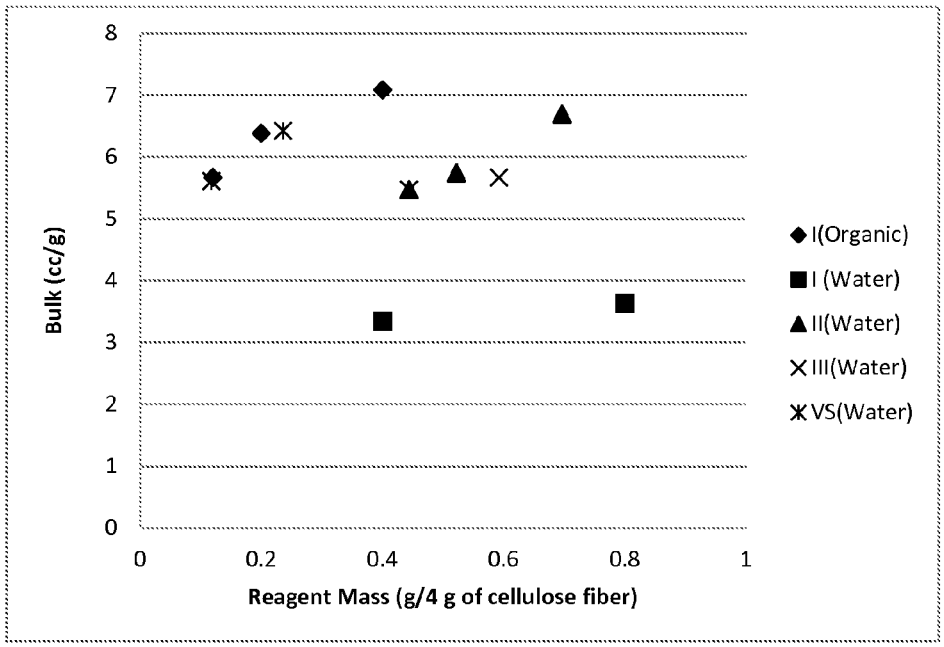
FIG. 1 is a graph of sheet bulk (y-axis) versus reagent mass (x-axis) and illustrates the effect of the amount of reagent and solvent type on the bulk of handsheets comprising modified fiber.
Figure 2:
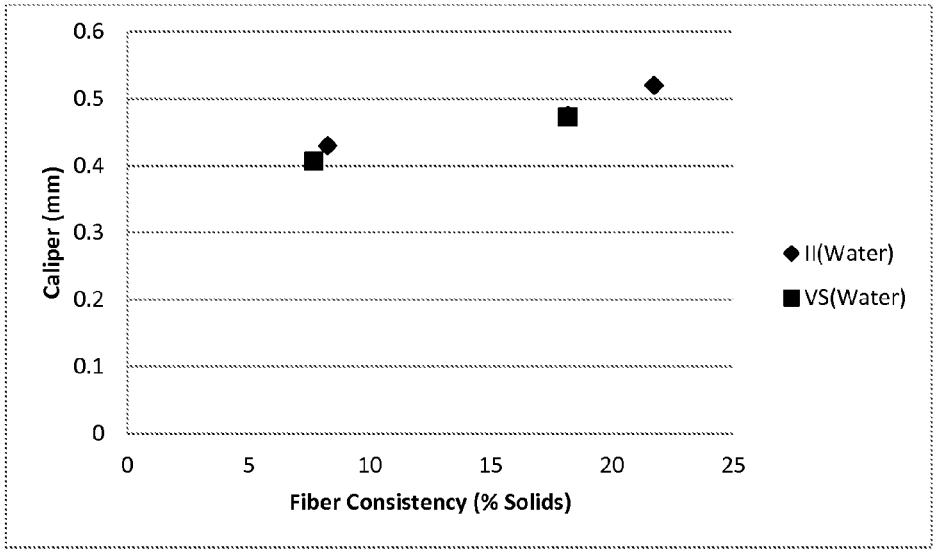
FIG. 2 is a graph of sheet caliper (y-axis) versus fiber consistency (x-axis) and illustrates the effect of fiber consistency on the caliper of handsheets comprising modified fiber.
Figure 3:
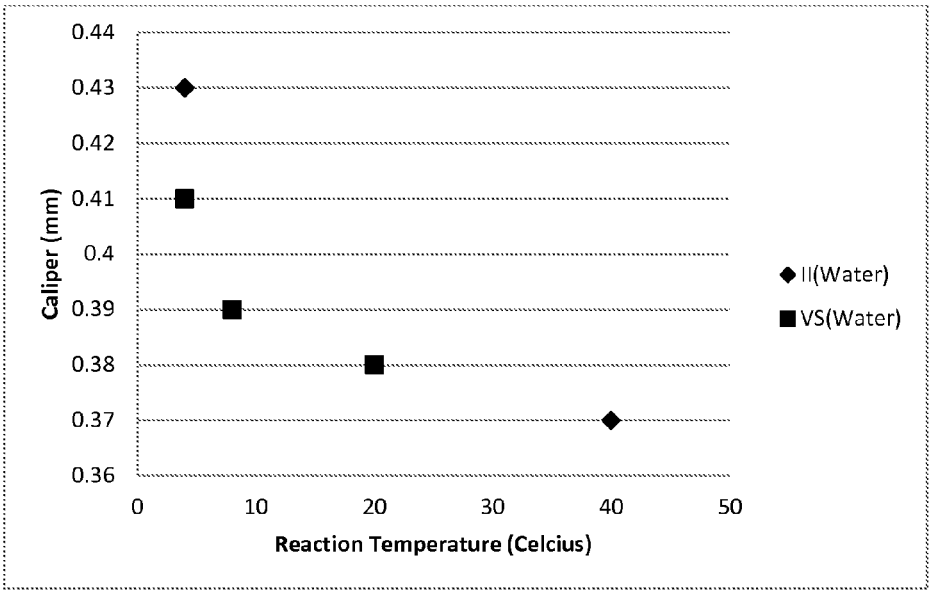
FIG. 3 is a graph of sheet caliper (y-axis) versus reaction temperature (x-axis) and illustrates the effect of temperature on the caliper of handsheets comprising modified fiber.
Figure 4:
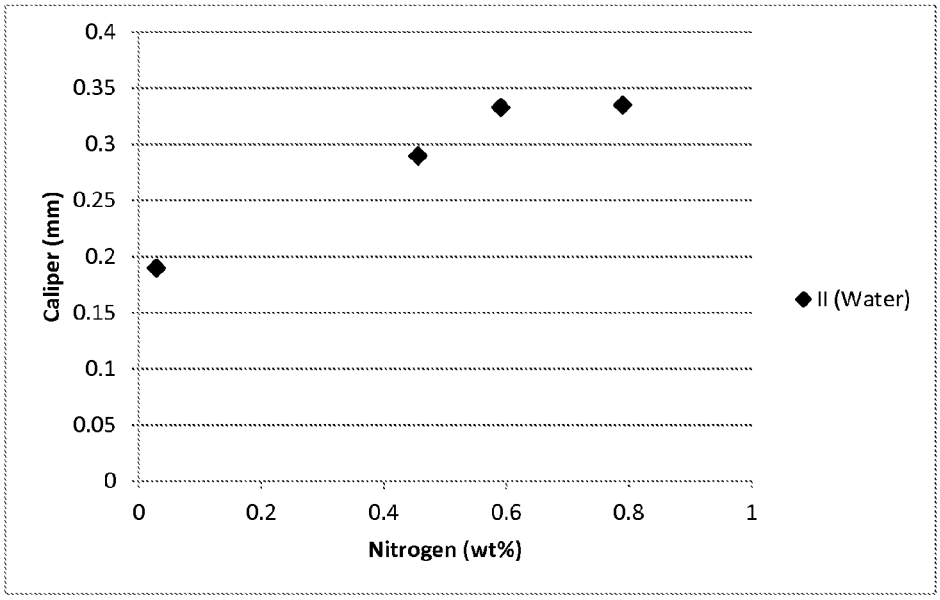
FIG. 4 is a graph of sheet caliper (y-axis) versus nitrogen content (x-axis) and illustrates the effect of nitrogen content on the caliper of handsheets comprising modified fiber.
Figure 5:
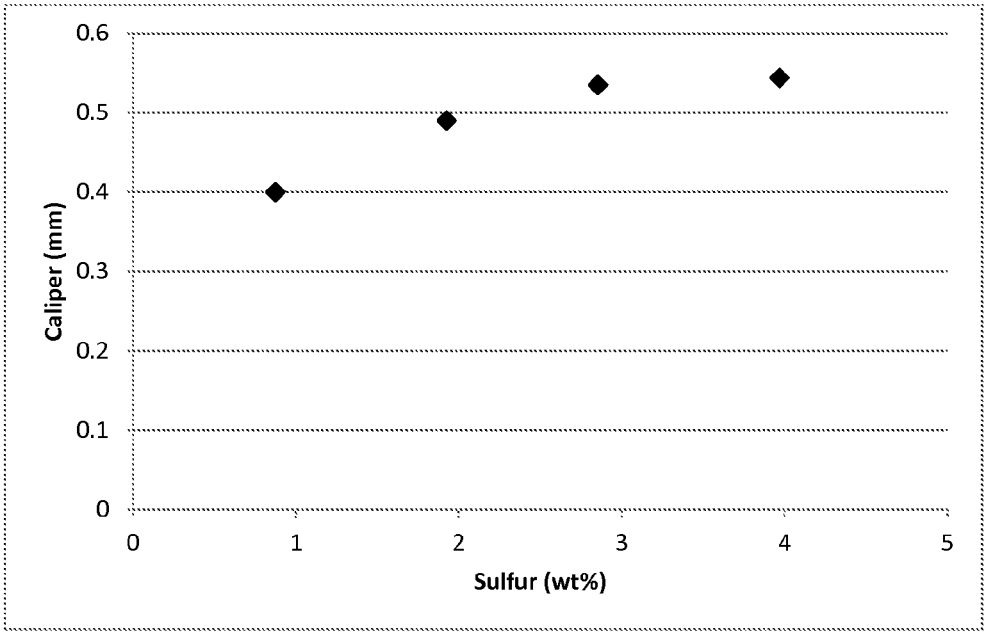
FIG. 5 is a graph of sheet caliper (y-axis) versus sulfur content (x-axis) and illustrates the effect of sulfur content on the caliper of handsheets comprising modified fiber.

As used herein the term "modified fiber" refers to any cellulosic fibrous material that has been reacted with a water soluble reagent selected from either a cyanuric halide having the general Formula (I) or a vinyl sulfone having the general Formula (II).

As used herein, the term "geometric mean tensile" (GMT) refers to the square root of the product of the machine direction tensile and the cross-machine direction tensile of the web, which are determined as described in the Test Method section.

As used herein, the term "tissue product" refers to products made from tissue webs and includes, bath tissues, facial tissues, paper towels, industrial wipers, foodservice wipers, napkins, medical pads, and other similar products.

As used herein, the terms "tissue web" and "tissue sheet" refer to a fibrous sheet material suitable for use as a tissue product.

As used herein, the term "caliper" is the representative thickness of a single sheet measured in accordance with TAPPI test methods T402 "Standard Conditioning and Testing Atmosphere For Paper, Board, Pulp Handsheets and Related Products" and T411 om-89 "Thickness (caliper) of Paper, Paperboard, and Combined Board" with Note 3 for stacked sheets. The micrometer used for carrying out T411 om-89 is an Emveco 200-A Tissue Caliper Tester (Emveco, Inc., Newberg, Oreg.). The micrometer has a load of 2 kilo-Pascals, a pressure foot area of 2500 square millimeters, a pressure foot diameter of 56.42 millimeters, a dwell time of 3 seconds and a lowering rate of 0.8 millimeters per second. Caliper may be expressed in mils (0.001 inches) or microns.

As used herein, the term "layer" refers to a plurality of strata of fibers, chemical treatments, or the like, within a ply.

As used herein, the terms "layered tissue web," "multi-layered tissue web," "multi-layered web," and "multi-layered paper sheet," generally refer to sheets of paper prepared from two or more layers of aqueous papermaking furnish which are preferably comprised of different fiber types. The layers are preferably formed from the deposition of separate streams of dilute fiber slurries, upon one or more endless foraminous screens. If the individual layers are initially formed on separate foraminous screens, the layers are subsequently combined (while wet) to form a layered composite web.

The term "ply" refers to a discrete product element. Individual plies may be arranged in juxtaposition to each other. The term may refer to a plurality of web-like components such as in a multi-ply facial tissue, bath tissue, paper towel, wipe, or napkin.

DETAILED DESCRIPTION

The present invention provides a modified cellulosic fiber having reduced hydrogen bonding capabilities. The modified fiber formed in accordance with the present invention may be useful in the production of tissue products having improved bulk and softness. More importantly, the modified fiber is adaptable to current tissue making processes and may be incorporated into a tissue product to improve bulk and softness without an unsatisfactory reduction in tensile. The cellulosic fiber formed in accordance with the invention is modified cellulosic fiber that has been reacted with a water soluble reagent selected from either a cyanuric halide or a vinyl sulfone. A decreased ability to hydrogen bond is imparted to the cellulosic fiber through reaction of the cellulosic fiber hydroxyl functional groups with the water soluble reagent, which impedes the hydroxyl functional groups from participating in hydrogen bonding with one. Preferably the number of hydroxyl groups reacted on each cellulosic fiber are sufficient to impede hydrogen bonding to a degree sufficient to enhance bulk and softness, but not so significant so as to negatively affect tensile strength. For example, preferably the modified cellulosic fiber increases sheet bulk by at least about 25 percent, such as from about 25 to about 100 percent, while only decreasing the tissue product's tensile index by less than about 25 percent, and more preferably by less than about 20 percent.

Wood pulp fibers are a preferred starting material for preparing the modified cellulosic fibers of the invention. Wood pulp fibers may be formed by a variety of pulping processes, such as kraft pulp, sulfite pulp, thermomechanical pulp, and the like. Further, the wood fibers may be any high-average fiber length wood pulp, low-average fiber length wood pulp, or mixtures of the same. One example of suitable high-average length wood pulp fibers include softwood fibers such as, but not limited to, northern softwood, southern softwood, redwood, red cedar, hemlock, pine (e.g., southern pines), spruce (e.g., black spruce), combinations thereof, and the like. One example of suitable low-average length wood pulp fibers include hardwood fibers, such as, but not limited to, eucalyptus, maple, birch, aspen, and the like. In certain instances, eucalyptus fibers may be particularly desired to increase the softness of the web. Eucalyptus fibers can also enhance the brightness, increase the opacity, and change the pore structure of the tissue product to increase its wicking ability. Moreover, if desired, secondary fibers obtained from recycled materials may be used, such as fiber pulp from sources such as, for example, newsprint, reclaimed paperboard, and office waste.

In a particularly preferred embodiment hardwood pulp fibers modified with a water soluble reagent selected from either a cyanuric halide or a vinyl sulfone are utilized in the formation of tissue products to enhance their bulk and softness. In one particular embodiment, water soluble cyanuric halide modified hardwood pulp fibers, and more particularly modified eucalyptus kraft pulp fibers, are incorporated into a multi-layered web having a first layer comprising a blend of modified and unmodified hardwood kraft fibers and a second layer comprising softwood fiber. In such embodiments the modified fiber may be added to the first layer, such that the first layer comprises greater than about 2 percent, by weight of the layer, modified fiber, such as from about 2 to about 40 percent and more preferably from about 5 to about 30 percent.

The chemical composition of the modified fiber of the invention depends, in part, on the extent of processing of the cellulosic fiber from which the modified fiber is derived. In general, the modified fiber of the invention is derived from a fiber that has been subjected to a pulping process (i.e., a pulp fiber). Pulp fibers are produced by pulping processes that seek to separate cellulose from lignin and hemicellulose leaving the cellulose in fiber form. The amount of lignin and hemicellulose remaining in a pulp fiber after pulping will depend on the nature and extent of the pulping process. Thus, in certain embodiments the invention provides a modified fiber comprising lignin, cellulose, hemicellulose and a covalently bonded cyanuric halide.

Generally after reaction of the cyanuric halide and the pulp hydroxyl functional groups unreacted water soluble reagent is removed by washing. After washing, the extent of reaction between the pulp hydroxyl function groups and the water soluble reagent may be assessed by nitrogen elemental analysis in the case of a cyanuric halide reagent or sulfur elemental analysis in the case of a vinyl sulfone reagent of the modified pulp, with higher amounts of nitrogen indicating a greater extent of reaction. Accordingly, in one embodiment the modified fiber has a nitrogen content from about 0.05 to about 5 weight percent and more preferably from about 0.1 to about 3 weight percent.

In one embodiment the modified fiber comprises a cellulosic fiber that has been reacted with a halogen atom attached to a polyazine ring, for example fluorine, chlorine or bromine atoms attached to a pyridazine, pyrimidine or symtriazine ring. One preferred type of cyanuric halide reagent contains an aromatic ring having two reactive halide functional groups attached thereto. Particularly preferred reagents are water soluble dichlorotrizines having the general formula (I):

(I)

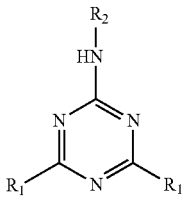

in which $R_1$ equals F, Cl, Br, or I and $R_2$ equals $(CH_2)_n$—OH (n=1-3), $(CH_2)_n$—COOH (n=1-3), $C_6H_5$—COOH, or $HSO_3X$ where X equals $(CH_2)_n$ (n=1-3) or $C_6H_4$. In a particularly preferred embodiment the water soluble cyanuric halide is a dichlorotrizines having the formula:

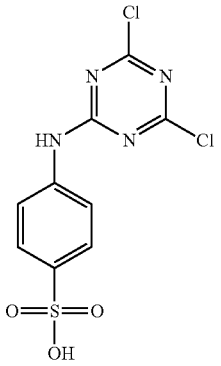

In other embodiments the modified fiber comprises a cellulosic fiber that has been reacted with a vinyl sulfone. Particularly preferred vinyl sulfone reagents are water soluble vinyl sulfones having the general formula (II):

(II)

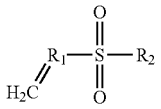

in which $R_1$ equals a hydrocarbon having from about 1 to about 5 carbon atoms and $R_2$ equals $CH_3$, HC═$CH_2$, $(CH_2)_n$—$CH_3$ (n=1-3), $(CH_2)_n$—COOH (n=1-3), $C_6H_4$—COOH, or $C_6H_5$.

Preferably the water soluble reagents have a water solubility of greater than about 5 mg/mL and more preferably greater than about 10 mg/mL and still more preferably greater than about 100 mg/mL, when measured at 60° C. The water solubility of the reagent provides the advantage of simplifying the modification process, reducing costs and improving reaction yields of modified fibers.

Reaction with a water soluble reagent, compared to a water insoluble reagent such as 2,4,6-trichlorotriazine, provides the additional benefit of reducing the degree of crosslinking between cellulosic fibers. For example, 2-(4,6-dichloro-(1,3,5)-triazine-2 aminoyl) ethanesulfonic acid is less reactive with cellulosic fibers than 2,4,6-trichlorotriazine because the most reactive chloride group has been substituted with amino ethane sulfonic acid to increase water solubility. The reduced reactivity and reduced number of halide functional groups results in less fiber crosslinking, which yields a modified fiber that is less stiff and more susceptible to processing, such as by refining.

Any suitable process may be used to generate or place the water soluble reagents on the cellulosic fibers, which is generally referred to herein as "modification." Possible modification processes include any synthetic method(s) which may be used to associate the water soluble reagent with the cellulosic fibers. More generally, the modification step may use any process or combination of processes which promote or cause the generation of a modified cellulosic fiber. For example, in certain embodiments the cellulosic fiber is first reacted with a water soluble reagent followed by alkaline treatment and then washing to remove excess alkali and unreacted reagent. In addition to alkali treatment, the cellulosic fiber may also be subjected to swelling. Alkali treatment and swelling may be provided by separate agents, or the same agent.

In a particularly preferred embodiment modification is carried out by alkali treatment to generate anionic groups, such as carboxyl, sulfate, sulfonate, phosphonate, and/or phosphate on the cellulosic fiber. Alkali treatment may be carried out before, after or coincidental to reaction with the water soluble reagent. Anionic groups are preferably generated under alkaline conditions, which in a preferred embodiment, is obtained by using sodium hydroxide. In other embodiments the alkaline agent is selected from hydroxide salts, carbonate salts and alkaline phosphate salts. In still other embodiments the alkaline agent may be selected from alkali metal or alkaline earth metal oxides or hydroxides; alkali silicates; alkali aluminates; alkali carbonates; amines, including aliphatic hydrocarbon amines, especially tertiary amines; ammonium hydroxide; tetramethyl ammonium hydroxide; lithium chloride; N-methyl morpholine N-oxide; and the like.

In addition to the generation of anionic groups by the addition of an alkaline agent, swelling agents may be added to increase access for modification. Interfibrillar and intercrystalline swelling agents are preferred, particularly swelling agents used at levels which give interfibrillar swelling, such as sodium hydroxide at an appropriately low concentration to avoid negatively affecting the rheological performance of the fiber.

Either prior to or after alkali treatment, the cellulosic fiber is reacted with a water soluble reagent to form a modified fiber. The amount of reagent will vary depending on the type of cellulosic fiber, the desired degree of modification and the desired physical properties of the tissue web formed with modified fibers. In certain embodiments the mass ratio of cellulosic fiber to reagent is from about 5:0.05 to about 2:1, more preferably from about 5:0.1 to about 4:1, such that the weight percentage of reagent, based upon the cellulosic fiber is from about 1 to about 50 percent and more preferably from about 2 to about 25 percent.

Further, modification may be carried out at a variety of fiber consistencies. For example, in one embodiment modification is carried out at a fiber consistency greater than about 5 percent solids, more preferably greater than about 10 percent solids, such as from about 10 to about 50 percent solids. In those embodiments where the water soluble reagent is mixed with the cellulosic fiber prior to alkali treatment it is particularly preferred that modification be carried out at a fiber consistency greater than about 10 percent, such as from about 10 to about 30 percent, so as to limit hydrolysis of the reagent.

Preferably the reaction of reagent and cellulosic fibers is carried out in an aqueous-alkaline solution having a pH value greater than about seven, more preferably greater than nine and more preferably greater than about ten. More preferably the aqueous-alkaline solution does not include an organic solvent and the water soluble reagent is not dissolved in an organic solvent prior to addition to the aqueous-alkaline solution.

The reaction time and temperature should be sufficient for the degree of modification, measured as the weight percent of nitrogen present in the fiber, where the reagent is a water soluble halide, is at least about 0.05 weight percent, such as from about 0.05 to about 5 weight percent, and more preferably from about 0.1 to about 3 weight percent. Accordingly, in certain embodiments, the treatment according to the invention can be carried at a temperature from about 0 about 40° C. The usual treatment times at 20° C. are from 30 minutes to 24 hours, more preferably from about 30 minutes to 10 hours, and more preferably from about 40 minutes to 5 hours.

As noted previously, the degree of modification may be measured by elemental analysis of the reacted cellulosic fiber. For example, where the water soluble reagent is a cyanuric halide, the nitrogen content of fiber is increased upon modification. The increase in nitrogen results mainly from the heterocyclically bonded nitrogen of the modified triazine ring, because the nitrogen content for an unmodified cellulose fiber material is very low, generally less than about 0.01 percent. Upon reaction with a water soluble cyanuric halide as described herein, the nitrogen content may be increased to greater than about 0.05 weight percent, and more preferably greater than about 0.1 weight percent, such as from about 0.1 to about 5 and still more preferably from about 0.3 to about 1 weight percent.

Webs that include the modified fibers can be prepared in any one of a variety of methods known in the web-forming art. In a particularly preferred embodiment modified fibers are incorporated into tissue webs formed by through-air drying and can be either creped or uncreped. For example, a papermaking process of the present disclosure can utilize adhesive creping, wet creping, double creping, embossing, wet-pressing, air pressing, through-air drying, creped through-air drying, uncreped through-air drying, as well as other steps in forming the paper web. Some examples of such techniques are disclosed in U.S. Pat. Nos. 5,048,589, 5,399,412, 5,129,988 and 5,494,554 all of which are incorporated herein in a manner consistent with the present disclosure. When forming multi-ply tissue products, the separate plies can be made from the same process or from different processes as desired.

For example, in one embodiment, tissue webs may be creped through-air dried webs formed using processes known in the art. To form such webs, an endless traveling forming fabric, suitably supported and driven by rolls, receives the layered papermaking stock issuing from the headbox. A vacuum box is disposed beneath the forming fabric and is adapted to remove water from the fiber furnish to assist in forming a web. From the forming fabric, a formed web is transferred to a second fabric, which may be either a wire or a felt. The fabric is supported for movement around a continuous path by a plurality of guide rolls. A pick up roll designed to facilitate transfer of web from fabric to fabric may be included to transfer the web.

Preferably the formed web is dried by transfer to the surface of a rotatable heated dryer drum, such as a Yankee dryer. The web may be transferred to the Yankee directly from the throughdrying fabric or, preferably, transferred to an impression fabric which is then used to transfer the web to the Yankee dryer. In accordance with the present disclosure, the creping composition of the present disclosure may be applied topically to the tissue web while the web is traveling on the fabric or may be applied to the surface of the dryer drum for transfer onto one side of the tissue web. In this manner, the creping composition is used to adhere the tissue web to the dryer drum. In this embodiment, as the web is carried through a portion of the rotational path of the dryer surface, heat is imparted to the web causing most of the moisture contained within the web to be evaporated. The web is then removed from the dryer drum by a creping blade. The creping web as it is formed further reduces internal bonding within the web and increases softness. Applying the creping composition to the web during creping, on the other hand, may increase the strength of the web.

In another embodiment the formed web is transferred to the surface of the rotatable heated dryer drum, which may be a Yankee dryer. The press roll may, in one embodiment, comprise a suction pressure roll. In order to adhere the web to the surface of the dryer drum, a creping adhesive may be applied to the surface of the dryer drum by a spraying device. The spraying device may emit a creping composition made in accordance with the present disclosure or may emit a conventional creping adhesive. The web is adhered to the surface of the dryer drum and then creped from the drum using the creping blade. If desired, the dryer drum may be associated with a hood. The hood may be used to force air against or through the web.

In other embodiments, once creped from the dryer drum, the web may be adhered to a second dryer drum. The second dryer drum may comprise, for instance, a heated drum surrounded by a hood. The drum may be heated from about 25 to about 200° C., such as from about 100 to about 150° C.

In order to adhere the web to the second dryer drum, a second spray device may emit an adhesive onto the surface of the dryer drum. In accordance with the present disclosure, for instance, the second spray device may emit a creping composition as described above. The creping composition not only assists in adhering the tissue web to the dryer drum, but also is transferred to the surface of the web as the web is creped from the dryer drum by the creping blade.

Once creped from the second dryer drum, the web may, optionally, be fed around a cooling reel drum and cooled prior to being wound on a reel.

For example, once a fibrous web is formed and dried, in one aspect, the creping composition may be applied to at least one side of the web and the at least one side of the web may then be creped. In general, the creping composition may be applied to only one side of the web and only one side of the web may be creped, the creping composition may be applied to both sides of the web and only one side of the web is creped, or the creping composition may be applied to each side of the web and each side of the web may be creped.

Once creped the tissue web may be pulled through a drying station. The drying station can include any form of a heating unit, such as an oven energized by infra-red heat, microwave energy, hot air, or the like. A drying station may be necessary in some applications to dry the web and/or cure the creping composition. Depending upon the creping composition selected, however, in other applications a drying station may not be needed.

In other embodiments, the base web is formed by an uncreped through-air drying process such as those described, for example, in U.S. Pat. Nos. 5,656,132 and 6,017,417, both of which are hereby incorporated by reference herein in a manner consistent with the present disclosure. The uncreped through-air drying process may comprise a twin wire former having a papermaking headbox which injects or deposits a furnish of an aqueous suspension of wood fibers onto a plurality of forming fabrics, such as an outer forming fabric and an inner forming fabric, thereby forming a wet tissue web. The forming process may be any conventional forming process known in the papermaking industry. Such formation processes include, but are not limited to, Fourdriniers, roof formers such as suction breast roll formers, and gap formers such as twin wire formers and crescent formers.

The wet tissue web forms on the inner forming fabric as the inner forming fabric revolves about a forming roll. The inner forming fabric serves to support and carry the newly-formed wet tissue web downstream in the process as the wet tissue web is partially dewatered to a consistency of about 10 percent based on the dry weight of the fibers. Additional dewatering of the wet tissue web may be carried out by known paper making techniques, such as vacuum suction boxes, while the inner forming fabric supports the wet tissue web. The wet tissue web may be additionally dewatered to a consistency of at least about 20 percent, more specifically between about 20 to about 40 percent, and more specifically about 20 to about 30 percent.

The forming fabric can generally be made from any suitable porous material, such as metal wires or polymeric filaments. For instance, some suitable fabrics can include, but are not limited to, Albany 84M and 94M available from Albany International (Albany, N.Y.) Asten 856, 866, 867, 892, 934, 939, 959, or 937; Asten Synweve Design 274, all of which are available from Asten Forming Fabrics, Inc. (Appleton, Wis.); and Voith 2164 available from Voith Fabrics (Appleton, Wis.). The wet web is then transferred from the forming fabric to a transfer fabric while at a solids consistency of between about 10 to about 35 percent, and particularly, between about 20 to about 30 percent. As used herein, a "transfer fabric" is a fabric that is positioned between the forming section and the drying section of the web manufacturing process.

Transfer to the transfer fabric may be carried out with the assistance of positive and/or negative pressure. For example, in one embodiment, a vacuum shoe can apply negative pressure such that the forming fabric and the transfer fabric simultaneously converge and diverge at the leading edge of the vacuum slot. Typically, the vacuum shoe supplies pressure at levels between about 10 to about 25 inches of mercury. As stated above, the vacuum transfer shoe (negative pressure) can be supplemented or replaced by the use of positive pressure from the opposite side of the web to blow the web onto the next fabric. In some embodiments, other vacuum shoes can also be used to assist in drawing the fibrous web onto the surface of the transfer fabric.

Typically, the transfer fabric travels at a slower speed than the forming fabric to enhance the MD and CD stretch of the web, which generally refers to the stretch of a web in its cross (CD) or machine direction (MD) (expressed as percent elongation at sample failure). For example, the relative speed difference between the two fabrics can be from about 1 to about 30 percent, in some embodiments from about 5 to about 20 percent, and in some embodiments, from about 10 to about 15 percent. This is commonly referred to as "rush transfer." During "rush transfer," many of the bonds of the web are believed to be broken, thereby forcing the sheet to bend and fold into the depressions on the surface of the transfer fabric 8. Such molding to the contours of the surface of the transfer fabric 8 may increase the MD and CD stretch of the web. Rush transfer from one fabric to another can follow the principles taught in any one of the following patents, U.S. Pat. Nos. 5,667,636, 5,830,321, 4,440,597, 4,551,199, 4,849,054, all of which are hereby incorporated by reference herein in a manner consistent with the present disclosure. The wet tissue web is then transferred from the transfer fabric to a throughdrying fabric.

While supported by the throughdrying fabric, the wet tissue web is dried to a final consistency of about 94 percent or greater by a throughdryer. The drying process can be any noncompressive drying method which tends to preserve the bulk or thickness of the wet web including, without limitation, throughdrying, infra-red radiation, microwave drying, etc. Because of its commercial availability and practicality, throughdrying is well known and is one commonly used means for noncompressively drying the web for purposes of this invention. Suitable throughdrying fabrics include, without limitation, fabrics with substantially continuous machine direction ridges whereby the ridges are made up of multiple warp strands grouped together, such as those disclosed in U.S. Pat. Nos. 6,998,024 and 7,611,607, both of which are incorporated herein in a manner consistent with the present disclosure, particularly the fabrics denoted as Fred (t1207-77), Jetson (t1207-6) and Jack (t1207-12). The web is preferably dried to final dryness on the throughdrying fabric, without being pressed against the surface of a Yankee dryer, and without subsequent creping.

Additionally, webs prepared according to the present disclosure may be subjected to any suitable post processing including, but not limited to, printing, embossing, calendering, slitting, folding, combining with other fibrous structures, and the like.

The basis weight of tissue webs made in accordance with the present disclosure can vary depending upon the final product. For example, the process may be used to produce bath tissues, facial tissues, paper towels, and the like. In general, the basis weight of such fibrous products may vary from about 5 to about 110 gsm, such as from about 10 to about 90 gsm. For bath tissue and facial tissues products, for instance, the basis weight of the product may range from about 10 to about 40 gsm.

Likewise, tissue web basis weight may also vary, such as from about 5 to about 50 gsm, more preferably from about 10 to about 30 gsm and still more preferably from about 14 to about 20 gsm.

In multiple-ply products, the basis weight of each web present in the product can also vary. In general, the total basis weight of a multiple ply product will generally be from about 10 to about 100 gsm. Thus, the basis weight of each ply can be from about 10 to about 60 gsm, such as from about 20 to about 40 gsm.

Tissue webs and products produced according to the present disclosure also have good bulk characteristics, regardless of the method of manufacture. For instance, conventional wet pressed tissue prepared using modified fibers may have a sheet bulk greater than about 5 $cm^3/g$, such as from about 5 to about 15 $cm^3/g$ and more preferably from about 8 to about 10 $cm^3/g$. In other embodiments through-air dried tissue and more preferably uncreped through-air dried tissue comprising modified fibers have a sheet bulk greater than about 10 $cm^3/g$, such as from about 10 to about 20 $cm^3/g$ and more preferably from about 12 to about 15 $cm^3/g$.

In addition to varying the amount of modified fiber within the web, as well as the amount in any given layer, the physical properties of the web may be varied by specifically selecting particular layer(s) for incorporation of the modified fibers. For example, it has now been discovered that the greatest increase in bulk and softness, without significant decreases in tensile strength, may be achieved by forming a two layered tissue web where the modified fibers are selectively incorporated into the first layer and the second layer consists essentially of softwood kraft fibers.

In a particularly preferred embodiment, the present disclosure provides a tissue web having enhanced bulk and softness without a significant decrease in tensile, where the web comprises a first and a second fibrous layer, wherein the first fibrous layer comprises hardwood kraft fibers and modified fibers and the second fibrous layer comprises softwood kraft fibers, wherein the amount of modified fibers is from about 2 to about 80 percent by weight of the web. Preferably multi-layered webs having modified fibers selectively incorporated into the first fibrous layer have basis weights of at least about 15 gsm and geometric mean tensile strengths greater than about 300 g/3", such as from about 300 to about 1500 g/3".

While the web properties, such as tensile, bulk and softness may be varied by selectively incorporating modified fibers into a particular layer of a multi-layered web, the benefits of using modified fibers may also be achieved by blending modified fibers and wood fibers to form a blended tissue web. In particular, modified fibers may be blended with wood fibers to increase bulk and softness, compared to webs made from wood fibers alone. Such blended tissue webs comprise at least about 5 percent by weight of the web modified fiber, and more preferably at least 10 percent, such as from about 10 to about 50 percent, and have a geometric mean tensile strength greater than about 300 g/3" and more preferably greater than about 500 g/3", such as from about 500 to about 700 g/3".

In other embodiments the present disclosure provides a two-ply tissue product comprising an upper multi-layered tissue web and a lower multi-layered tissue web that are plied together using well-known techniques. The multi-layered webs comprise at least a first and a second layer, wherein modified fibers are selectively incorporated in only one of the layers, such that when the webs are plied together the layers containing the modified fibers are brought into contact with the user's skin in-use. For example, the two-ply tissue product may comprise a first and second tissue web, wherein the tissue webs each comprise a first and second layer. The first layer of each tissue web comprises wood fibers and modified fibers and, while the second layer of each tissue web is substantially free of modified fibers. When the tissue webs are plied together to form the tissue product the second layers of each web are arranged in a facing relationship such that the modified fibers are brought into contact with the user's skin in-use.

Test Methods

Sheet Bulk

Sheet Bulk is calculated as the quotient of the dry sheet caliper expressed in microns, divided by the dry basis weight, expressed in grams per square meter (gsm). The resulting Sheet Bulk is expressed in cubic centimeters per gram. More specifically, the Sheet Bulk is the representative caliper of a single tissue sheet measured in accordance with TAPPI test methods T402 "Standard Conditioning and Testing Atmosphere For Paper, Board, Pulp Handsheets and Related Products" and T411 om-89 "Thickness (caliper) of Paper, Paperboard, and Combined Board." The micrometer used for carrying out T411 om-89 is an Emveco 200-A Tissue Caliper Tester (Emveco, Inc., Newberg, Oreg.). The micrometer has a load of 2 kilo-Pascals, a pressure foot area of 2500 square millimeters, a pressure foot diameter of 56.42 millimeters, a dwell time of 3 seconds and a lowering rate of 0.8 millimeters per second.

Tensile

Tensile testing was done in accordance with TAPPI test method T-576 "Tensile properties of towel and tissue products (using constant rate of elongation)" wherein the testing is conducted on a tensile testing machine maintaining a constant rate of elongation and the width of each specimen tested is 3 inches. More specifically, samples for dry tensile strength testing were prepared by cutting a 3±0.05 inch (76.2±1.3 mm) wide strip in either the machine direction (MD) or cross-machine direction (CD) orientation using a JDC Precision Sample Cutter (Thwing-Albert Instrument Company, Philadelphia, Pa., Model No. JDC 3-10, Serial No. 37333) or equivalent. The instrument used for measuring tensile strengths was an MTS Systems Sintech 11S, Serial No. 6233. The data acquisition software was an MTS TestWorks® for Windows Ver. 3.10 (MTS Systems Corp., Research Triangle Park, N.C.). The load cell was selected from either a 50 Newton or 100 Newton maximum, depending on the strength of the sample being tested, such that the majority of peak load values fall between 10 to 90 percent of the load cell's full scale value. The gauge length between jaws was 4±0.04 inches (101.6±1 mm) for facial tissue and towels and 2±0.02 inches (50.8±0.5 mm) for bath tissue. The crosshead speed was 10±0.4 inches/min (254±1 mm/min), and the break sensitivity was set at 65 percent. The sample was placed in the jaws of the instrument, centered both vertically and horizontally. The test was then started and ended when the specimen broke. The peak load was recorded as either the "MD tensile strength" or the "CD tensile strength" of the specimen depending on direction of the sample being tested. Ten representative specimens were tested for each product or sheet and the arithmetic average of all individual specimen tests was recorded as the appropriate MD or CD tensile strength the product or sheet in units of grams of force per 3 inches of sample. The geometric mean tensile (GMT) strength was calculated and is expressed as grams-force per 3 inches of sample width. Tensile energy absorbed (TEA) and slope are also calculated by the tensile tester. TEA is reported in units of gm*cm/cm$^2$. Slope is recorded in units of kg. Both TEA and Slope are directional dependent and thus MD and CD directions are measured independently. Geometric mean TEA and geometric mean slope are defined as the square root of the product of the representative MD and CD values for the given property.

EXAMPLES

Modified wood pulps were prepared by mixing about 4 g of eucalyptus kraft pulp with a predetermined amount of cyanuric chloride (I), 2-(4,6-dichloro-(1,3,5)-triazine-2 aminoyl) benzylsulfonic acid (II), 2-(4,6-dichloro-(1,3,5)-triazine-2 aminoyl), ethanesulfonic acid (III) or divinyl sulfone (VS) and a predetermined amount of NaOH. The reaction mixture was stored at 4° C. for about 12 hours and then the pulp was washed three times with water at a pulp consistency of about 2 percent. The reaction conditions for each sample are set forth in Table 1, below.

TABLE 1

| Sample No. | Pulp (g) | Reagent (g) | NaOH (g) | Solvent (g) |
|---|---|---|---|---|
| 1 | 4 | I (0.12) | 0.24 | Acetone (80) |
| 2 | 4 | I (0.20) | 0.24 | Acetone (80) |
| 3 | 4 | I (0.40) | 0.24 | Acetone (80) |
| 4 | 4 | II (0.522) | 0.10 | Water (16) |
| 5 | 4 | II (0.696) | 0.15 | Water (16) |
| 6 | 4 | III (0.444) | 0.10 | Water (16) |
| 7 | 4 | III (0.592) | 0.15 | Water (16) |
| 8 | 4 | VS (0.118) | 0.1 | Water (16) |
| 9 | 4 | VS (0.236) | 0.2 | Water (16) |
| 10 | 4 | I (0.40) | 0.24 | Water (16) |
| 11 | 4 | I (0.40) | 0.24 | Water (48) |
| 12 | 4 | I (0.80) | 0.24 | Water (48) |

Handsheets were prepared using a lab handsheet former (Retention & Drainage Analyzer, GE-RDA-T6, commercially available from GIST Co., Ltd., Daejeon, Korea). The pulp (either treated or control) was mixed with distilled water to form slurries at a ratio of 25 g pulp (on dry basis) to 2 L of water. The pulp/water mixture was subjected to disintegration using an L&W disintegrator Type 965583 for 5 minutes at a speed of 2975±25 RPM. After disintegration the mixture was further diluted by adding 4 L of water. Handsheets having a basis weight of 70.5 g/m$^2$ (gsm) were formed using the wet laying handsheet former. Wet handsheets were pressed using a Carver AutoFour/15H-12 press at a pressure of 8000 KGS for 1 minute without the addition of heat. The pressed handsheet was then dried at 250° F. for 2 minutes. Handsheet caliper and tensile were measured and are reported in Table 2, below.

TABLE 2

| Sample No. | Caliper (mm) | Sheet Bulk (cc/g) |
|---|---|---|
| 1 | 0.400 | 5.67 |
| 2 | 0.450 | 6.38 |
| 3 | 0.500 | 7.08 |
| 4 | 0.405 | 5.74 |
| 5 | 0.472 | 6.69 |
| 6 | 0.386 | 5.47 |
| 7 | 0.400 | 5.67 |
| 8 | 0.396 | 5.61 |
| 9 | 0.453 | 6.42 |
| 10 | 0.236 | 3.34 |
| 11 | 0.273 | 3.87 |
| 12 | 0.256 | 3.63 |

The effect of pulp consistency on the caliper of resulting handsheets was explored further by preparing handsheets from modified and unmodified pulps, as set forth in Table 3, below.

TABLE 3

| Sample No. | Pulp (g) | Agent (g) | NaOH (g) | Water (g) | Pulp Consistency (%) | Caliper (mm) |
|---|---|---|---|---|---|---|
| 1 | 4 | II (1.044) | 0.132 | 44.4 | 8.26 | 0.43 |
| 2 | 4 | II (1.044) | 0.132 | 18.0 | 18.18 | 0.475 |
| 3 | 4 | II (1.044) | 0.132 | 14.4 | 21.74 | 0.52 |
| 4 | 4 | VS (0.471) | 0.24 | 48.0 | 7.69 | 0.407 |
| 5 | 4 | VS (0.471) | 0.24 | 18.0 | 18.18 | 0.473 |

In addition to the effect of pulp consistency on the caliper of resulting handsheets, the effect of temperature was also explored by preparing handsheets from modified and unmodified pulps, as set forth in Table 4, below.

TABLE 4

| Sample No. | Pulp (g) | Agent (g) | NaOH (g) | Water (g) | Temperature (° C.) | Caliper (mm) |
|---|---|---|---|---|---|---|
| 1 | 4 | II (1.044) | 0.132 | 44.4 | 4 | 0.43 |
| 2 | 4 | II (1.044) | 0.132 | 44.4 | 20 | 0.38 |
| 3 | 4 | II (1.044) | 0.132 | 44.4 | 40 | 0.37 |
| 4 | 4 | VS (0.236) | 0.24 | 18.0 | 4 | 0.41 |
| 5 | 4 | VS (0.236) | 0.24 | 18.0 | 8 | 0.39 |
| 6 | 4 | VS (0.236) | 0.24 | 18.0 | 20 | 0.38 |

The relationship between elemental nitrogen content and caliper was explored further by preparing handsheets from pulps reacted with different amounts of nitrogen. The reaction mixture was stored at 20° C. for about 12 hours and then the pulp was washed three times with water at a pulp consistency of about 2 percent. The nitrogen content of the pulps was determined by elemental analysis. Handsheets were then prepared from the modified pulps as described above. The reaction conditions and the physical characteristics of the resulting modified pulp and handsheets is summarized in Table 5, below.

TABLE 5

| Reagent II (g) | Nitrogen (%) | Caliper (mm) |
|---|---|---|
| 0 | 0.029 | 0.190 |
| 0.56 | 0.456 | 0.290 |
| 0.68 | 0.591 | 0.333 |
| 0.8 | 0.790 | 0.335 |

The relationship between elemental sulfur content and caliper was explored further by preparing handsheets from pulps reacted with different amounts of VS Modified pulps, which were prepared by mixing a predetermined amount of VS and NaOH. The reaction mixture was stored at 40° C. for about 12 hours and then the pulp was washed three times with water at a pulp consistency of about 2 percent. The sulfur content of the pulps was determined by elemental analysis. Handsheets were then prepared from the modified pulps as described above. The reaction conditions and the physical characteristics of the resulting modified pulp and handsheets are summarized in Table 6, below.

TABLE 6

| Reagent (g) | Sulfur (%) | Caliper (mm) |
|---|---|---|
| 0.4 | 0.87 | 0.4 |
| 0.8 | 1.93 | 0.49 |
| 1.2 | 2.85 | 0.535 |
| 1.6 | 3.97 | 0.544 |

We claim:

1. A tissue web comprising unmodified and modified wood pulp fibers, the modified wood pulp fibers consisting of wood pulp fibers reacted only with a reagent consisting essentially of a water soluble cyanuric halide having the general Formula (I):

(I)

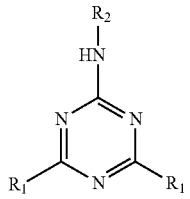

where $R_1$ equals F, Cl, Br, or I and $R_2$ equals $(CH_2)_n$—OH (n=1-3), $(CH_2)_n$—COOH (n=1-3), $C_6H_5$—COOH, or $HSO_3X$ where X equals $(CH_2)_n$ (n=1-3) or C6H4, the modified wood pulp fibers having a nitrogen content greater than about 0.2 weight percent, the tissue web having a basis weight from about 10 to about 60 gsm and a sheet bulk greater than about 10 cc/g.

2. The tissue web of claim 1 wherein the amount of modified wood pulp fiber is from about 5 to about 80 percent of the weight of the web.

3. The tissue web of claim 1 wherein the modified wood pulp fiber comprises a softwood or a hardwood kraft fiber.

4. The tissue web of claim 1 wherein the nitrogen content of the web is from about 0.2 to about 0.5 weight percent.

5. The tissue web of claim 4 wherein the web is a creped tissue web having a sheet bulk from about 10 to about 15 cc/g and a basis weight from about 10 to about 20 gsm.

6. The tissue web of claim 4 wherein the web is an uncreped tissue web having a sheet bulk from about 12 to about 20 cc/g and a basis weight from about 20 to about 40 gsm.

* * * * *